US005828187A

United States Patent [19]

Fischer

[11] Patent Number: 5,828,187

[45] Date of Patent: Oct. 27, 1998

[54] METHOD AND CIRCUIT ARRANGEMENT FOR OPERATING A DISCHARGE LAMP

[75] Inventor: Klaus Fischer, Müchen, Germany

[73] Assignee: Patent-Treuhand-Gesellschaft fur elektrische Gluhlampen mbH, Munich, Germany

[21] Appl. No.: 764,491

[22] Filed: Dec. 12, 1996

[30] Foreign Application Priority Data

Dec. 13, 1995 [DE] Germany ..... 195 46 588.1

[51] Int. Cl.[6] ..... H05B 37/02

[52] U.S. Cl. ..... 315/291; 315/307; 315/DIG. 5

[58] Field of Search ..... 315/307, 308, 315/224, DIG. 4, DIG. 5, 291, 94, 105, 106, 209 R

[56] References Cited

U.S. PATENT DOCUMENTS

| | | | |
|---|---|---|---|
| 4,647,817 | 3/1987 | Fahnrich et al. | 315/104 |
| 5,048,033 | 9/1991 | Donahue et al. | 372/38 |
| 5,063,490 | 11/1991 | Machara et al. | 363/37 |
| 5,128,592 | 7/1992 | Dean et al. | 315/224 |

*Primary Examiner*—Don Wong
*Assistant Examiner*—David H. Vu

[57] ABSTRACT

The invention relates to a method and a circuit arrangement for operating a discharge lamp. In the preheating phase, the actual value of the load current is registered, a first time-invariant setpoint value of the load current, which corresponds to a desired actual value of a load current in the preheating phase, is formed, and a clock generator is activated, which runs freely at a frequency which is less than the resonant frequency of the load circuit when the lamp is off and is greater than the resonant frequency of the load circuit when the lamp is on. The preheating phase is terminated after a first predeterminable time period has elapsed. In the striking phase, the actual value of the load current in the load circuit is registered, a time-varying setpoint value of the load current is formed, and the clock generator is synchronized with the frequency of an inverter. The striking phase is terminated as soon as the setpoint value of the load current reaches a value at which an on-time of a half-bridge switching element is greater than the period of the free-running clock generator. In normal operation, the actual value of the load current is registered and a second time-invariant setpoint value of the load current is formed, which setpoint value corresponds to a desired actual value of the load current in normal operation.

25 Claims, 4 Drawing Sheets

METHOD AND CIRCUIT ARRANGEMENT FOR OPERATING A DISCHARGE LAMP

FIELD OF THE INVENTION

The invention relates to a method and a circuit arrangement for operating a discharge lamp.

BACKGROUND OF THE INVENTION

In lamp ballasts for high-frequency operation of low-operation discharge lamps, the mains voltage is rectified and smoothed. The DC voltage is usually converted, using an inverter which is preferably configured as a half-bridge arrangement, into a high-frequency AC voltage by means of which the lamp is supplied with electrical energy via a series tuned circuit.

In circuits of this type, the switching elements should be supplied with drive power in time with the switching frequency.

In the power range of up to 25 W, use is usually made, at the present time, almost exclusively of so-called free-running circuit designs which, for controlling switching elements (in particular transistors) of the inverter or of the half-bridge, either provide separate current transformers (saturable-current transformers or as a transformer with defined air gap) or secondary windings on the lamp coil with signal-shaping networks for each half-bridge switch. In this context, "free-running" means that the drive power for the switching elements of the inverter is drawn directly from the load circuit.

However, these free-running circuit designs have the disadvantage that losses in the drive circuits (saturable-current transformer, secondary windings on the lamp coil with signal-shaping networks) impair the efficiency of the overall arrangement, and that a relatively large number of components (drive-circuit components) is required.

Progress in semiconductor technology permits integrated circuit or drive design in which the control of the two half-bridge transistors can be implemented in an integrated circuit. The drive power for the transistors is provided by drivers which are controlled by digital signals. This circuit design is denoted by the term "externally controlled".

Hitherto known embodiments for externally controlled half-bridges with integrated drive use oscillators which usually switch the switching elements (usually voltage-controlled transistors such as FET transistors (Field-Effect Transistor) or IGBT transistors (Insulated Gate Bipolar Transistor)) of the inverter on and off via drivers at a fixed, unregulated frequency.

However, with such solutions in which only one oscillator frequency can be predetermined, it is virtually impossible to preheat the filaments without a component (for example PTC resistor in parallel with a part or all of the capacitor (C5 in FIG. 1) in parallel with the lamp, cf. EP 0 185 179 B1) which varies the natural resonant frequency of the load circuit.

With alternative solutions to this, in which one or more further fixed oscillator frequencies are predetermined in order to produce preheating, optimum preheating of the lamp filaments before striking of the lamp cannot, however, be achieved for the reasons explained below.

For preheating the filaments, the frequency of the inverter should be chosen, in accordance with the Q-factor of the load circuit, in such a way that it lies within a specific frequency range. If the frequency of the inverter is above the upper limit of this frequency range, then, for a fixed preheating duration, the current flowing in the load circuit is not sufficient to heat the lamp filaments to a temperature at which they can emit. If the frequency of the inverter is below the lower limit of this frequency range, the voltage across the capacitor (C5) connected in parallel with the lamp (cf. EL in FIG. 1) is greater than the maximum value defined by the lamp (EL), as a result of which the lamp strikes early.

The Q-factor of the load circuit depends on the components, which determine the frequency and are usually subject to tolerances, in the load circuit (coil L2, capacitor CS and C6) and on the damping in the load circuit which is caused by the ohmic impedances (primarily the filament resistances and the active resistance of the coil L2).

In hitherto known embodiments, a fixed controlled frequency of the oscillator is likewise predetermined by components subject to tolerances. On the basis of usual tolerances in the electronic components of the load circuit, the required frequency for preheating cannot be produced reliably without matching of the oscillator frequency to the load-circuit Q-factor actually existing in a ballast. However, it is scarcely possible to match each ballast during production on grounds of cost. Since, as the preheating progresses, the resistance of the filaments increases because they heat up, the damping in the load circuit also increases. If the oscillator frequency then remains constant in the course of the preheating, the current in the load circuit decreases in accordance with the reduction in the quality of the load circuit.

Improved preheating could be produced by reducing the frequency of the inverter during the preheating, in such a way that the current in the load circuit remains substantially constant throughout the preheating phase. It is, however, not possible when using a fixed oscillator frequency.

A further disadvantage of the known solutions with a single fixed operating frequency of the inverter can be seen from the following considerations:

The resonance of the load circuit, which is given $$f_{res1} = \frac{1}{2\pi \cdot \sqrt{L2 \cdot \frac{C5 \cdot C6}{C5 + C6}}}$$

must have a value which makes it possible to produce a sufficient voltage across the capacitor (C5 in FIG. 1) connected in parallel with the lamp, at the same oscillator frequency as the one employed by the inverter during normal lamp operation. The capacitor (C5) therefore has an unusually high capacitance, with the result that a large current flows in the lamp filaments during normal lamp operation. Apart from the fact that a capacitor with the said high capacitance must be provided, a further disadvantage consists in that the filaments are overloaded and the overall efficiency of the arrangement is reduced.

SUMMARY OF THE INVENTION

On the basis of this, the object of the invention is to specify a method and a circuit arrangement of the type mentioned at the start, which permit sufficient preheating of the lamp filaments with external control of the switching elements of the inverter.

This object is achieved by a method and by a circuit arrangement which are defined in the claims.

The invention has many advantages.

A first advantage of practical importance consists in the fact that it is simple to produce in terms of circuit technology. All control functions can be produced in an integrated circuit. In terms of circuit technology, all functions required by the proposed method can be embodied in such a way that for externally connecting this integrated circuit, only relatively inexpensive resistors are required for setting operating parameters.

A second important advantage of the proposed method consists in that many of the functions to be produced in a circuit arrangement by circuit technology can be used in all operating phases of the lamp and it is therefore necessary only to provide the parameters characteristic of the operating phases.

A further advantageous embodiment of the method according to the invention is characterized in that each individual period of the load current is regulated to a predeterminable setpoint value in each operating phase of the lamp. This provides a simple and robust control mechanism, substantially unaffected by tolerances, since only simple comparison functions are required instead of control characteristics, subject to tolerances, which are otherwise required.

In conjunction with this, provision is advantageously made that the positive and negative half-cycles of the load current are regulated to the same setpoint value. Imposing the same setpoint value for positive and negative half-cycles of the load current inherently ensures that, in the setpoint-value formation, tolerances have equal effect in both the positive and negative half-cycles of the load current, and the ratio between the duty factors of the two half-bridge switching elements (transistors T1, T2) therefore remains constant. This advantage is supplemented by the further advantage that the formation of one setpoint value is simpler, as regards circuit technology, than the production of two separate setpoint values for positive and negative load-current half-cycles.

In conjunction with this, provision is made that, in order to regulate the period of the load current, the actual value of the integral of the current with respect to time in a half-oscillation or a full-oscillation of the load current is registered, and this integral is compared with the setpoint value of the integral of the current with respect to time in a half-oscillation or a full oscillation of the load current in the respective current operating phase. When the actual and setpoint values of the load current coincide, the inverter is driven in such a way that a switching element (T2 for example) activated at this particular time is deactivated and a switching element (T1 for example) not activated at this particular time is activated. In this case, the exceeding of the setpoint value by the actual value is a sufficient control criteria for changing the state of the inverter. By registering the actual integral of the current with respect to time and comparison with a setpoint current integral with respect to time, deactivation of the currently activated switching element takes place automatically at the time required for fulfilling the control task relating to the time profile of the current in the load circuit.

In conjunction with this, provision is furthermore made that a predeterminable dead time is produced between the deactivation of the switching element activated at this particular time and the activation of the switching element not activated at this particular time. The dead time permits reduction in the switching load of the switching elements, for example by connecting at least one capacitor in parallel with at least one of the two switching elements. As a result of this, the voltage gradient dU(t)/dt occurring at the half-bridge mid-point (terminal 9 in FIG. 1) when the half-bridge is switched over is limited. Neither of the two half-bridge switching elements is activated during the time in which the charge in this capacitor or these capacitors is transferred, beginning with the deactivation of the currently activated switching element, by means of the energy stored in the coil (L2).

According to the invention, in conjunction with this provision may furthermore be made that, in a first time period of a starting phase directly after the termination of the striking phase, a third, time-invariant setpoint value of the load current is formed for a predeterminable third time period. Imposing the third setpoint value after the termination of the striking phase makes it possible to apply an increased current to the load circuit for a predeterminable time period. The effect of this is that the starting response of the lamp is accelerated and the rated lighting current is reached more quickly.

In conjunction with this, provision is furthermore made that in a second time period of the starting phase, a second, time-varying setpoint value is formed, which is changed, from the third time-invariant setpoint value continuously to the second time-invariant setpoint value. Continuously changing from the third setpoint value to the second setpoint value leads to a more continuous transition, which is therefore scarcely perceptible to the observer of the discharge lamp, from the actual value corresponding to the third setpoint value to the actual value corresponding to the second setpoint value.

BRIEF DESCRIPTION OF THE DRAWINGS

The invention will now be explained with reference to the drawing, in which.

BEST MODE FOR CARRYING OUT THE INVENTION

Figure 1:
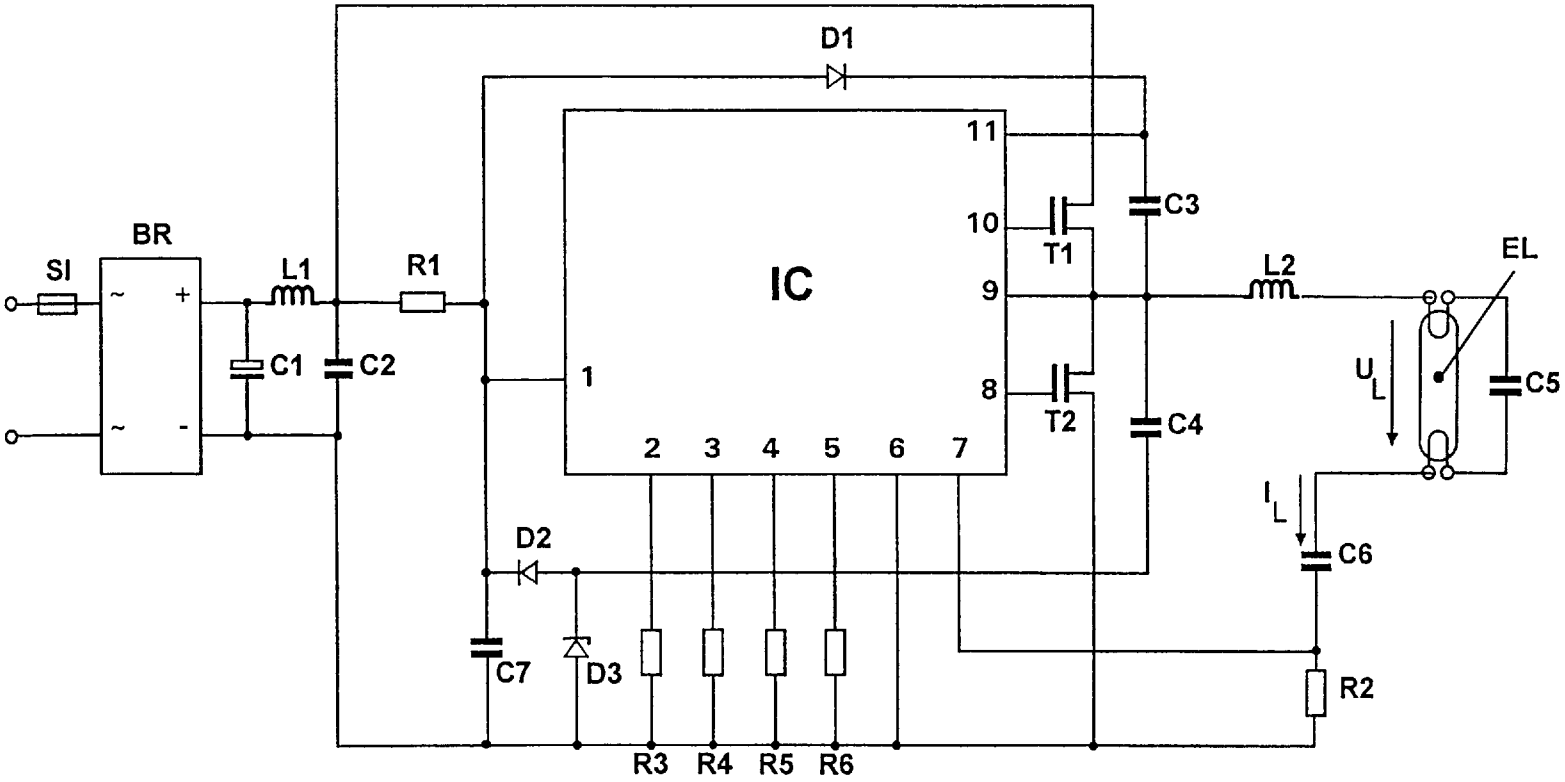
FIG. 1 shows an embodiment of a circuit arrangement according to the invention.

On the input side, the illustrative embodiment represented in FIG. 1, of a circuit arrangement according to the invention for operating a discharge lamp EL has, in a lead, a fuse SI, downstream of which a rectifier BR is connected. The output of the latter is bridged by a smoothing capacitor C1. The downstream-connected inductor L1 and the capacitor C2 form a radio interference suppression component.

Figure 2:
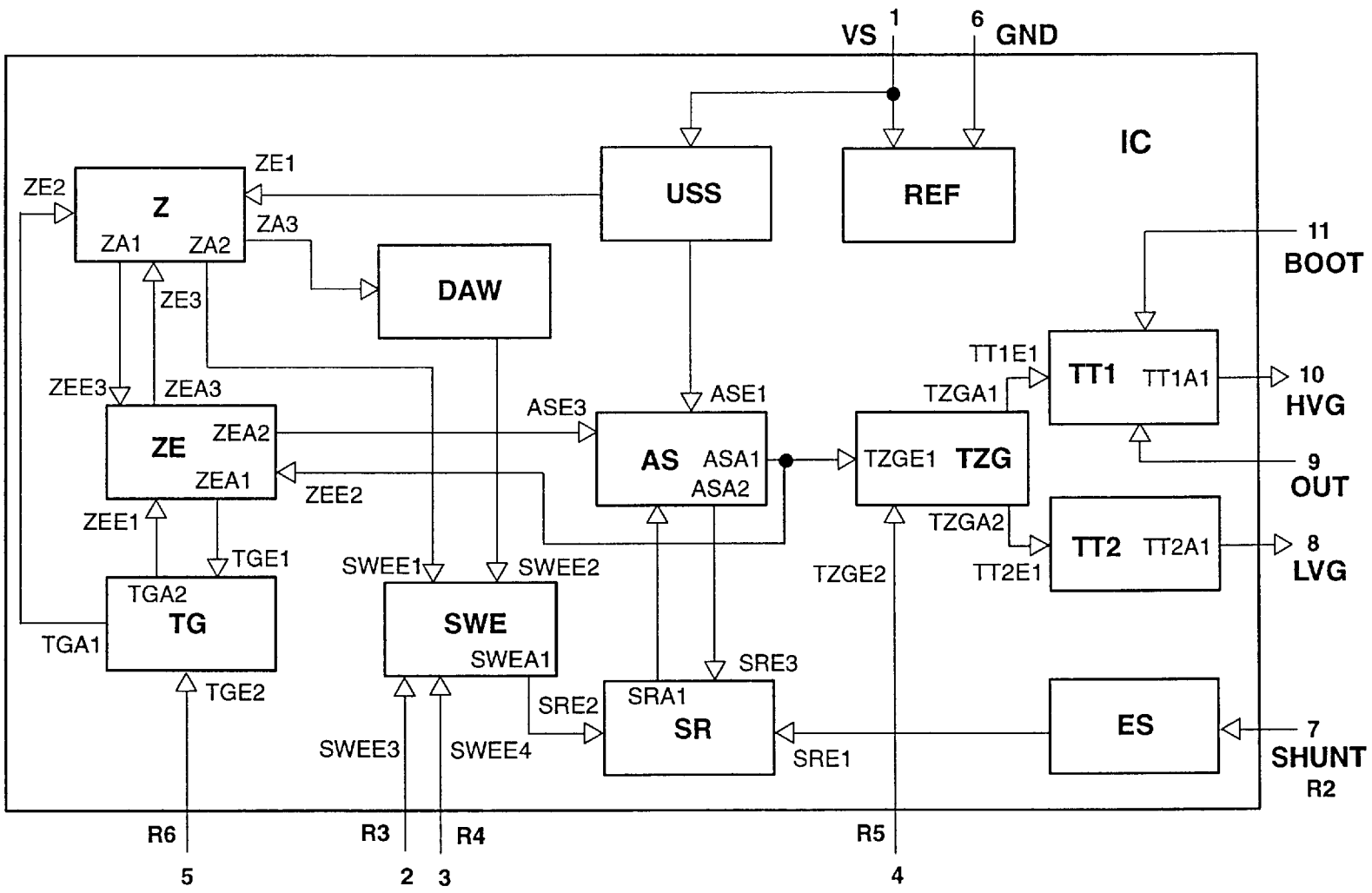
FIG. 2 shows a functional block circuit diagram of a control circuit in the circuit arrangement according to FIG. 1.

A circuit component IC, which may be constructed as represented in FIG. 2, is a control circuit for driving a transistor T1 (base or gate electrode terminal 10 of the control circuit IC) and a transistor T2 (base or gate electrode at terminal 8 of the control circuit IC). The two transistors T1 and T2 form a half-bridge arrangement, or an inverter. The resistors R3, R4, R5 and R6 are connected, on the one hand, to the terminals 2 and 5 and, on the other hand, to the terminal 6. A setpoint value (SW1, FIG. 4*a*) of the load current in the preheating phase is formed using the resistor R3, and a setpoint value (SW3, FIG. 4*a*) of the load current in the normal operating phase is formed using the resistor R4. A dead time, which delays the switching-on of one transistor after the switching-off of the other transistor, is programmed using the resistor R5. The function of this dead time will be described with reference to FIG. 2.

A capacitor C7 is used for smoothing the voltage supply for the circuit component IC. When the overall arrangement shown in FIG. 1 is turned on, this capacitor is charged through the resistor R1 by drawing energy from the mains. In order to minimize losses in the resistor R1, it is chosen with a very high resistance. However, a current larger than the current which can be supplied via R1 is required for a sufficient voltage supply of the circuit component IC. During operation of the overall arrangement, the circuit component IC is therefore supplied with energy from the load circuit at the frequency of the inverter. To this end, as well as to reduce the switching load of the two switching elements T1 and T2, the capacitor C4 is connected between the half-bridge mid-point (IC terminal 9), on the one hand, and the connection point of two diodes D2 and D3, on the other hand.

If T1 is activated, then the capacitor C4 is charged to the voltage across C2 less the voltage across the capacitor C7. If T1 is then deactivated, C4 is discharged by means of the energy stored in the coil L2, via the load circuit (L2, EL/C5, C6 and R2) and the diode D3. During this process, the voltage gradient dU(t)/dt at the half-bridge mid-point (IC terminal 9) and the switching losses in T1 are limited. While T2 is activated, C4 remains discharged. If T2 is then deactivated, C4 is charged by means of the energy stored in the coil L2, via the diodes D2, the capacitor C7 and the load circuit (L2, E1/C5, C6 and R2). This charging current leads to charging of C7, and the voltage gradient dU(t)/dt at the half-bridge mid-point (IC terminal 9) and the switching losses in T2 are limited in similar fashion to that described above.

As shown in FIG. 1, it is possible to limit the voltage across the capacitor C7 by designing the diode D3 as a Zener diode. Charging of C7 can continue only so long as the voltage across C7 plus the forward voltage of the diode D2 is less than the Zener voltage of the diode D3.

A further possibility for limiting the voltage across C7 is to implement a Zener diode in the circuit component IC with the cathode at terminal 1 and the anode at terminal 6.

Via the diode D1, which may be arranged inside (between the terminals 1 and 11) of the circuit IC or outside the circuit IC, a capacitor C3 connected to the terminal 9 of the circuit IC is charged to the voltage of C7 when the transistor T2 is activated (bootstrap stage consisting of D1 and C3).

At terminals 9 and 6 of the circuit IC, the load circuit is connected to the discharge lamp EL; this load circuit consists of a series circuit comprising the coil L2, the discharge lamp EL with the capacitor C5 connected in parallel, a capacitor C6 and a (shunt) resistor R2, which is connected between the terminals 6 and 7 of the control circuit IC. The resistor R2 registers the current flowing in the load circuit; the registered current value is fed at the terminal 7 to the control circuit IC which further processes this current value, as will be described later.

Before striking of the lamp EL, that is to say in the preheating phase and in the striking phase, the load circuit has a first resonance with the frequency $f_{res1}$, which is given by the formula $$f_{res1} = \frac{1}{2\pi \cdot \sqrt{L2 \cdot \frac{C5 \cdot C6}{C5 + C6}}}.$$

When the discharge lamp is struck, there is an abrupt change to a second resonance with the frequency $f_{res2}$, which is approximately given by the formula $$f_{res2} = \frac{1}{2\pi \cdot \sqrt{L2 \cdot C6}}$$

since the capacitor (C5 in FIG. 1) in parallel with the lamp is almost short-circuited by the lamp.

The frequency $f_{res1}$ of the first resonance (preheating phase TV and striking phase TZ in FIG. 4) is thus greater than the frequency $f_{res2}$ of the second resonance (starting phase TA and normal operation TN in FIG. 4), since C6 is greater than the series circuit consisting of C5 and C6. The period of the load current in the preheating phase TV and in the striking phase TZ is thus less than that of the load current in the starting phase and in normal operation.

FIG. 2 shows a functional block circuit diagram of an embodiment of the control circuit IC represented in FIG. 1. Some or all of the functional blocks represented in FIG. 2 can be produced as an integrated circuit.

Structure of the control circuit IC

The structure of an illustrative embodiment of the control circuit IC will be described below:

On the input side (terminal 7), the control circuit IC has an input stage ES. The input stage ES is connected to a current regulator circuit SR via the first input SRE1 of the latter. The current regulator circuit SR is furthermore connected via a second input SRE2 to a current setpoint-value generator circuit SWE and via a third input SRE3 and an output SRA1 to an output stage AS.

The current setpoint-value generator circuit SWE is connected via a first input SWEE1 to a counter Z and via a second input SWEE2 to a D/A converter DAW. The resistors R3 and R4 are furthermore connected to two further inputs SWEE3 and SWEE4 of the current setpoint-value generator circuit SWE, which are also terminals 2 and 3 of the control circuit IC. A time-invariant setpoint value SW1 is produced using R3 (FIG. 4*a*) and a time-invariant setpoint value SWS is produced using R4 (FIG. 4*a*).

A clock generator TG is connected via one input TGE1 to a striking-detection circuit ZE; it is furthermore connected via a first output TGA1 to the counter Z and via a second output TGA2 to the striking-detection circuit ZE. The resistor R6 is connected to an input TGE2, which is also terminal 5 of the control circuit IC.

The striking-detection circuit ZE is connected via one input ZEE1 to the clock generator TG, via a second input ZEE2 to the output stage AS and via a third input ZEE3 and a third output ZEA3 to the counter Z. The striking-detection circuit ZE is connected via a first output ZEA1 to the clock generator TG and via a second output ZEA2 to the output stage AS.

The counter Z is connected via a first input ZE1 to the undervoltage protection circuit USS, via a second input ZE2 to the clock generator TG and via a third input ZE3 and a first output ZA1 to the striking-detection circuit ZE. The counter Z is connected via a second output ZA2 to the current setpoint-value generator circuit SWE and via a third output ZA3 to the D/A converter DAW.

The output stage AS is connected via a first input ASE1 to the undervoltage protection circuit USS, via a second input ASE2 to the current regulator circuit SR and via a third input ASE3 to the striking-detection circuit ZE. The output stage AS is connected via a first output ASA1 to a lag component TZG and to the striking-detection circuit ZE; it is connected via a second output ASA2 to the current regulator circuit SR.

The lag component TZG is connected via one input TZGE1 to the output stage AS, via a first output TZGA1 to a first driver TT1 of the first transistor (FIG. 1) and via a second output TZGA2 to a second driver TT2 of the second transistor T2 (FIG. 1). The resistor R5 is connected to one input TZGE2, which is also a terminal 4 of the control circuit IC.

The first driver TT1 of the first transistor T1 (FIG. 1) and the second driver TT2 of the second transistor T2 (FIG. 1) are connected to the lag component TZG via inputs TT1E1 and TT2E1. The first driver TT1 is supplied with the energy required for controlling the transistor T1 via the IC terminal 1 or VS with a reference potential at the IC terminal 6 or GND. The second driver TT2 is supplied with the energy required for controlling the transistor T2 by the bootstrap stage which is formed by the capacitor C3 and the diode D1, via the IC terminal 11 or BOOT with a reference potential at the IC terminal 9 or out.

Via its output TT1A1 (also IC terminal 10 of the control circuit IC) the first driver TT1 controls the first transistor T1 (FIG. 1), and via its output TT2A1 (also IC terminal 8 of the control circuit IC) the second driver TT2 controls the second transistor T2 (FIG. 1).

A reference voltage circuit REF provides the individual circuit components inside the control circuit IC with a reference signal which is very accurate and ideally independent of any ambient conditions. To this end it is connected to the IC terminal 6 or GND and to the IC terminal 1 or VS, which is connected to the capacitor C7 (FIG. 1).

An undervoltage protection circuit USS evaluates the amplitude of the supply voltage at the IC terminal 1 (FIG. 1) or VS. If this voltage is below a predeterminable value, then the output stage AS is blocked by a corresponding signal via its input ASE1 and set to a defined initial state. At the same time, if the said voltage is below the predeterminable value, the counter Z is reset to its defined initial counting state by the undervoltage protection circuit USS via the counter input ZE1.

Mode of operation of the control circuit IC

The mode of operation of the above illustrative embodiment of the control circuit IC will be explained below:

When the mains voltage is applied to the overall arrangement, if there is a sufficiently high supply voltage at the IC terminal 1 (FIG. 1) or VS for the control by the undervoltage protection circuit USS via the output stage AS, an integrator in the current regulator SR is set to a defined start value and the half-bridge transistor T1 is switched on, in turn switching the load circuit to the rectified and smoothed mains voltage.

As a result, in the load circuit, current starts to flow through the lamp coil L2, the capacitor C5, the two filaments of the lamp, the capacitor C6 and the resistor R2, which current oscillates sinusoidally because of the resonant structure of the load circuit.

At the output of the integrator of the current regulator circuit SR, a voltage with cosinusoidal wave form is then produced which, starting from a fixed initial value, approaches the setpoint value formed by the current setpoint-value generator circuit SWE, in the course of the first half-cycle of the load current in the load circuit.

In this case, the output voltage of the integrator may decrease from a high start level (downward integration of the load current) or increase from a low start value (upward integration). Merely by way of example, upward integration will be assumed below.

If the output voltage of the integrator reaches the setpoint value, a comparator of the current regulator circuit SR delivers, at the output SRA1, a pulsed signal (FIG. 4*f*) which is forwarded to the output stage AS. This has the result that the half-bridge transistor T1 which is switched on is switched off and the transistor T2 which is switched off at this time is switched on after a dead time $t_T$ (FIG. 4, lines e1 and e2) produced by the lag component TZG. During this dead time $t_T$, the integrator is also reset to its initial value. After the dead time $t_T$ has elapsed, at the same time as the transistor T2 is switched on, the integrator again starts to integrate the resonant current, until its output voltage and the setpoint value again coincide, the transistor T2 is switched off and the dead time once more elapses before T1 is switched on again and the cycle for the next and all subsequent oscillations of the load current are thereby continued.

This free-running process affords the advantage that there need be no oscillator for exciting the series tuned circuit in the control system.

In all operating phases of the lamp, the registering of the actual value of the current $I_L$ in the load circuit (FIG. 1), and thereby of its frequency, takes place using the shunt resistor R2, the voltage drop $U_{Shunt}$ across this resistor being fed to the input stage ES.

The input stage ES amplifies this voltage drop and traces it, for example, in such a way that each half-cycle of the load current can be processed individually by the current regulator circuit SR connected downstream of the input stage ES.

The current regulator circuit SR consists of an integrator (not represented in FIG. 2) and of a comparator (not represented in FIG. 2).

The integrator integrates up the output signal of the input stage ES, which is taken at the input SRE1, starting from a fixed, predeterminable initial voltage $U_{int}(t=0)$ according to $$U_{int} = \frac{1}{R_{int} \cdot C_{int}} \cdot \int_{t=0}^{t=t_{End}} U_{Shunt}(t) \cdot dt$$

(t=0 when T1 or T2 are switched on;

$t=t_{END}$ when T1 or T2 are switched off)

In this formula, $R_{int}$ and $C_{int}$ denote a resistor and a capacitor, respectively, which are required for producing an integration function in SR from the circuit technology point of view.

Figure 4:
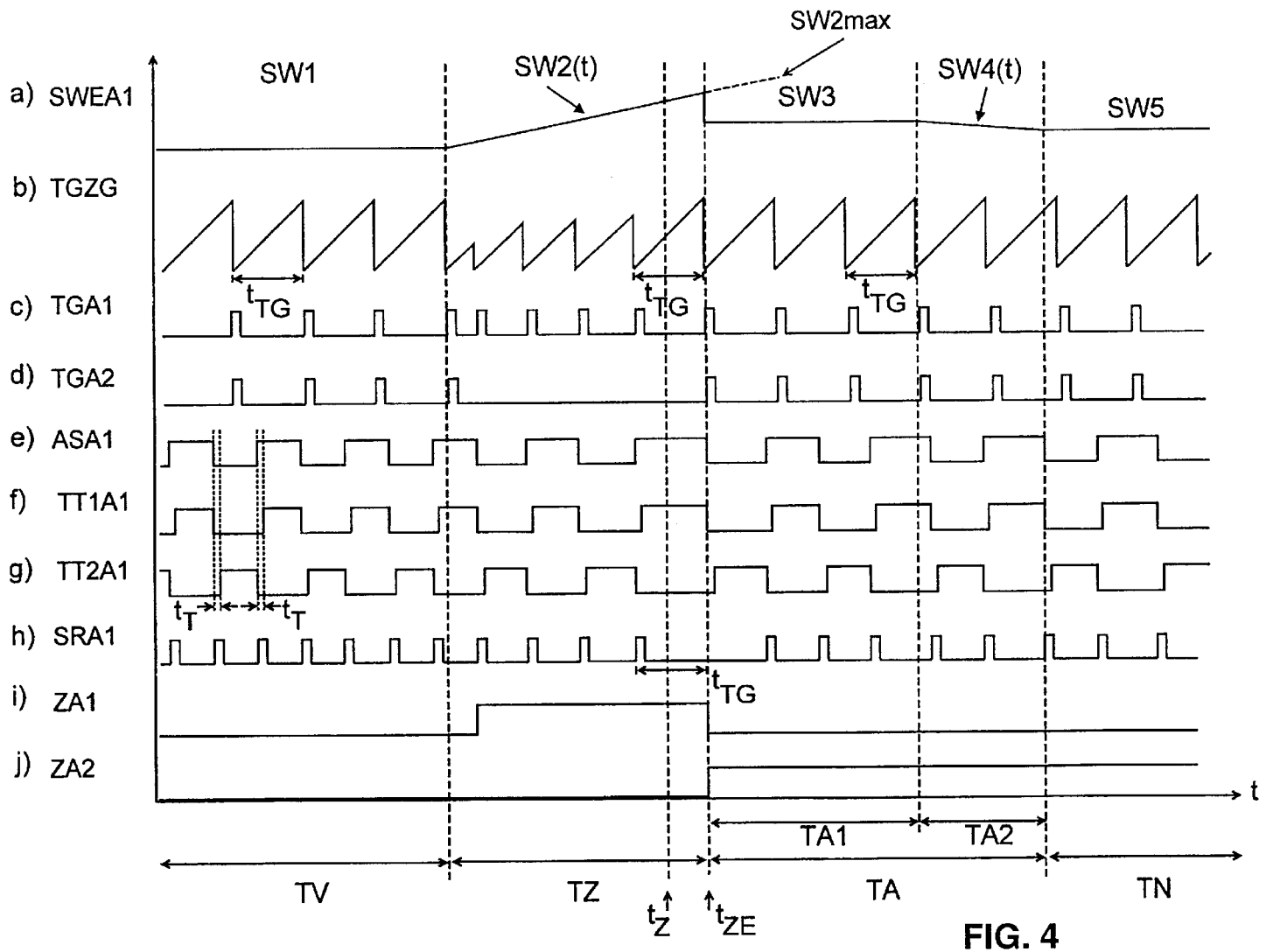
FIG. 4 schematically shows the time profiles of the output signals of selected circuit components of the circuit according to FIG. 1 and FIG. 2.

The comparator compares the output voltage $U_{int}$ of the integrator with setpoint values (SW1, SW2(t), SW3, SW4(t) SW5 in FIG. 4) of the load current which are formed by the current setpoint-value generator circuit SWE and are fed to the current regulator circuit SR via its input SRE3.

In the preheating phase TV (FIG. 4), the current setpoint-value generator circuit SWE produces a first time-invariant setpoint value SW1 (FIG. 4*a*) of the load current, which corresponds to the actual value desired for the preheating current in the preheating phase.

In the striking phase TZ (FIG. 4), the current setpoint-value generator circuit SWE produces a time-varying setpoint value SW2(t) of the load current, which setpoint value is brought from the first time-invariant setpoint value SW1 of the load current to a predeterminable value (for example SW2max in FIG. 4*a*).

In a first part TA1 of the starting phase TA, the current setpoint-value generator circuit SWE produces a second time-invariant setpoint value SW3 of the load current, which setpoint value corresponds to a desired actual value of the load current in the first part TA1 of the starting phase TA.

In a subsequent second part TA2 of the starting phase TA, the current setpoint-value generator circuit SWE produces a second time-varying setpoint value SW4(t) of the load current, which setpoint value is brought from the setpoint value SW3 of the load current to a setpoint value SW5 of the load current in the normal operating phase TN.

In the normal operating phase TN, the current setpoint-value generator circuit SWE produces the third time-invariant setpoint value SWS of the load current, which setpoint value corresponds to a desired actual value of the load current in the normal operating phase TN.

The current setpoint-value generator circuit SWE is controlled both by output signals of the counter Z (via the input SWEE1) and by output signals of the D/A converter DAW (via the input SWEE2).

As already mentioned, the current setpoint-value generator circuit SWE produces the setpoint value, corresponding to the respective operating phase, for the integral of the current with respect to time in a half-cycle of the current $I_L$ in the load circuit. Via its input SWEE1, the current setpoint-value generator circuit SWE receives the information from the output ZA2 of the counter Z (FIG. 4*h*) whether the overall arrangement is in the preheating phase TV or in the striking phase TZ (lamp EL not on) or in the starting phase TA or normal operating phase TN (lamp EL on).

For both phase groups (1: lamp not on; 2: lamp on), a predeterminable time-invariant setpoint value is produced, in each case via an external resistor (R3, R4) (cf. FIG. 4*a*: SW1 and SW5, respectively). If the D/A converter DAW then delivers an analog signal via the input SWEE2 to the current at setpoint-value generator circuit SWE, then as a function of the state of the input signal at the input SWEE1, one time-invariant setpoint value SW1 (defined through R3, preheating/striking phase) or the other time-invariant setpoint value SWS (defined through R4, starting/normal operating phase) is changed in accordance with the time profile and the magnitude of the analog signal at the input SWEE2 of the current setpoint-value generator circuit SWE. A first time-varying setpoint value SW2(t), a third time-invariant setpoint value SW3 and a second time-varying setpoint value SW4(t) are thereby formed.

Via the SR output SRA1, the comparator of the current regulator circuit SR delivers a switching pulse (FIG. 4*f*) to the output stage AS whenever the actual current, integrated upwards with respect to time, exceeds a setpoint current integral with respect to time, and the corresponding output voltage $U_{int}$ of the current regulator circuit integrator correspondingly exceeds the respective setpoint value (SW1, SW2(t), SW3, SW4(t), SWS).

Furthermore, during each dead time $t_T$ (FIG. 4*e*1, 4*e*2) of the lag component TZG, the integrator of the current regulator circuit SR is set to its initial state via the third input SRE3 of this circuit, which is connected to the output ASA2 of the output stage AS, in order to begin the next upward integration process for the next half-cycle of the load current $I_L$.

The clock generator TG consists of a timer component which defines a period $t_{TG}$, after the elapsing of which a temporally limited output pulse (FIG. 4*c*) is produced at the clock generator output TGA2, and of a feedback network which ensures that the period again elapses after this output pulse is produced. The free-running multivibrator resulting from this oscillates with the natural oscillation frequency $$f_{TG} = \frac{1}{t_{TG}} .$$

The period $t_{TG}$ can be predetermined using the external resistor R6 (FIG. 1).

The clock generator TG has a control input TGE1 so that it can be used as a timing component: If a control signal is applied to this control input TGE1, the timer component is, for so long as this control signal is applied, shifted to the state in which it is found in free-running operation at the start of each oscillation period.

Using the clock generator, it is thereby possible independently of the instantaneous state of its timer component, to predetermine the beginning of a period of an oscillation frequency differing from the natural oscillation frequency $f_{TG}$.

At the output TGA2, the clock generator TG delivers switching pulses (FIG. 4*d*) whenever its timer component is reset, to the state corresponding to the start of a period $t_{TG}$, by its feedback network after a period $t_{TG}$ has elapsed.

At the output TGA1 of the clock generator TG the switching signals which shift the timer component of the clock generator into its initial state are provided and are fed to the counter Z. If the clock generator TG operates as a timing component in the striking phase TZ, no signals are at first produced at the output TGA2, but switching signals with the frequency corresponding to the inverter frequency are forwarded via the output TGA1 to the counter Z. In free-running operation, TV, TA and TN, the clock generator TG produces at both outputs, TGA1 and TGA2, signals which are simultaneous and have the same frequency.

At the output TGA2 of the clock generator TG in the striking phase (ZE, yet to be described, is activated), a pulse (FIG. 4*d*) is produced at the particular time when the duration between two consecutive switching pulses at the control input TGE1 of the clock generator TG is greater than the period $t_{TG}$ of the period of the natural oscillation frequency $f_{TG}$ of the clock generator TG, defined by the timer component.

Via its input ZE1, the counter Z is set by the undervoltage protection circuit USS into a defined initial counting state. Starting from this initial counting state, the counter Z counts the switching signals fed via its input ZE2 from the clock generator TG. When a predeterminable counting state is reached, which takes place after the desired duration TV (FIG. 4) of the preheating phase, the counter Z activates, via its output ZA1, the striking-detection circuit ZE, by means of which the striking phase begins.

The counter Z indicates the end of the striking phase via the counter input ZE3.

By means of the state of the signal provided at the counter output ZA1, the counter Z indicates the striking phase. By means of the state of the signal provided at the output ZA2, the counter Z indicates whether the overall arrangement is in the preheating/striking phase TV/TZ (lamp not on) or in the starting/normal operating phase TA/TN (lamp on).

At its output ZA3, the counter Z provides individual sequences of predeterminable sequential counts (that is to say, for example, the counting states 298 to 450) which are converted in the D/A converter DAW into analog signals corresponding to the current counter state. These analog time-dependent signals allow temporally continuous variations in the setpoint values SW2(t) and SW4(t) for the current integral with respect to time of a current half-cycle in the load circuit, which are predetermined in the current regulator circuit SR in the striking phase TZ and in the part TA2 (FIG. 4) of the starting phase TA.

The D/A converter DAW converts into analog signals the counter states transferred to it by the counter Z. If no counter states are provided at the output ZA3 of the counter Z, DAW delivers no signal to the current setpoint-value generator circuit SWE.

Using a binary signal, the output stage AS drives the downstream-connected lag component TZG, in such a way that, after each switching signal which occurs at one of its inputs ASE2 (connected to the current regulator circuit SR) or ASE3 (connected to the striking-detection circuit ZE), this binary output signal ASA1 changes its state (function of a toggle flip-flop). Via the input ASE1, the output stage can be brought into a defined state by the undervoltage protection circuit USS.

The output stage AS applies to the lag component TZG a binary signal which indicates the state of the half-bridge (T1, T2 in FIG. 1). If the state of this signal at the output ASA1 of the output stage or at the input TZGE1 of the lag component TZG changes, then the lag component TZG deactivates, without delay, the driver (for example TT1) activated at this particular time and, after a dead time $t_T$, predeterminable through the external resistor R5, activates the last inactivated driver (for example TT2) (FIG. 4*e*, 4*e*1, 4*e*2).

Two power drivers TT1, TT2 amplify the control signals of the lag component TZG and directly drive the half-bridge transistors T1, T2 via the IC terminals 8 or LVG (Low Voltage Gate) and 10 or HVG (High Voltage Gate) (FIG. 1).

The striking-detection circuit ZE operates as a multiplexer for signal channels: If, by a signal at its output ZA1, the counter Z indicates to the striking-detection circuit ZE the beginning of the striking phase TZ (FIG. 4*g*), TZ applies the clock generator output TGA2 to the input ASE3 of the output stage AS and the output ASA1 of the output stage AS to the clock generator input TGE1.

ZE thus enables signal channels from AS to TG, the timer component of TG being set by control pulses from AS into its state corresponding to the beginning of a period of the timer component (connection path between ZEE2 and ZEAL), and the output stage AS being fed at its input ASE3 a control pulse from the output TGA2 of the TG (connection path between ZEE1 and ZEA2).

This makes it possible, in the striking phase, for the output stage AS to synchronize the clock-generator output TGA1 with the frequency of the inverter, with no switching pulse occurring at the clock-generator output TGA2 so long as the inverter frequency $f_{Inv}$ (FIG. 3), defined by the current regulator circuit SR, is greater than the frequency $f_{TG}$ of the free-running clock generator TG.

During the striking phase TZ, after the period $t_{TG}$ imposed in the timer component, the clock generator TG can change the state of the output stage AS and thereby indicate the striking to the counter Z via the input ZE3 of the latter, as a result of which the current setpoint-value generator circuit SWE sets the setpoint value to the value SW3 corresponding to the starting phase TA.

This is exactly the case when the time period between two switching pulses of the SR during the striking phase is greater than the period $t_{TG}$ of the TG.

The functions produced by the control device IC represented in FIG. 2 can also be produced by a differently structured control device, in particular, a microprocessor as well.

Figure 3:
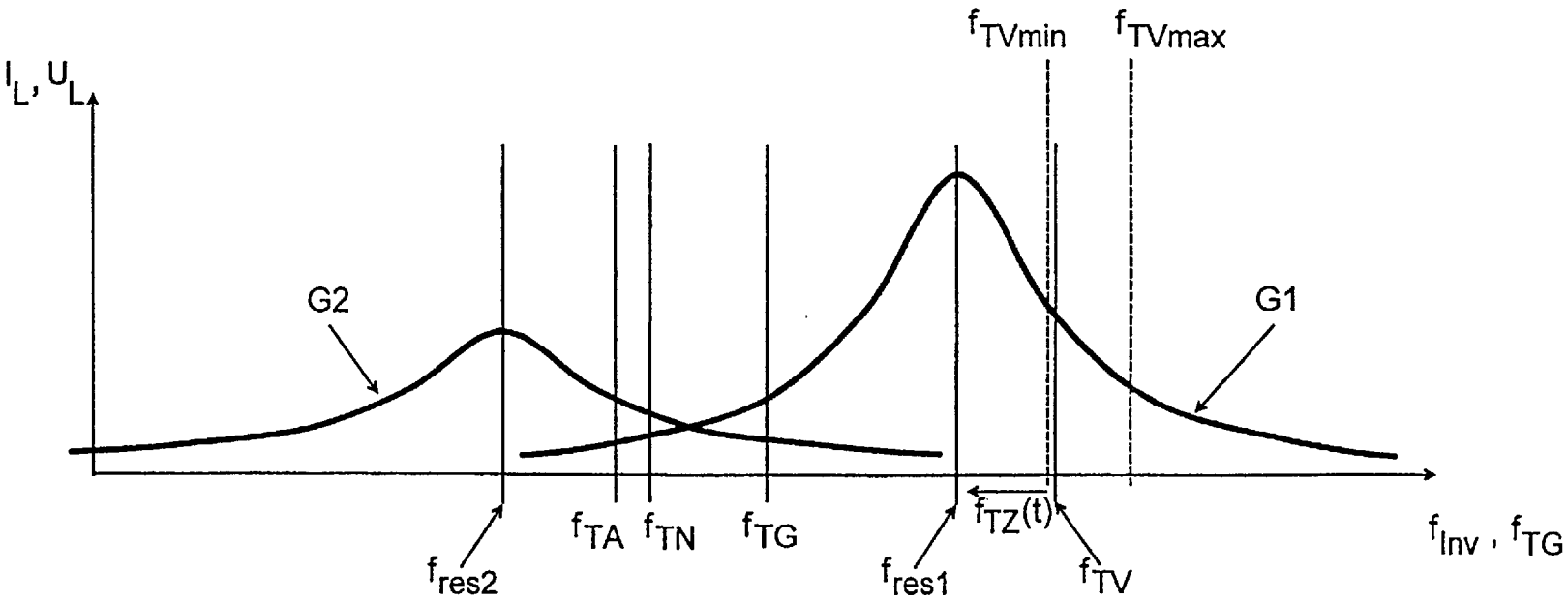
FIG. 3 shows a diagram which represents the relationship between the control frequency at which the inverter is driven and the natural resonant frequency of the load circuit before and after striking of the lamp.

FIG. 3 shows a schematic illustration of the frequency range of the working range of the overall arrangement. The frequency range in which the inverter operates is given on the abscissa, and the current $I_L$ in the load circuit, or the voltage $U_L$ across the discharge lamp EL, is given on the ordinate.

FIG. 3 shows two frequency responses:

1. The Q-factor G1 of the load circuit before striking of the lamp, with the resonance $f_{res1}$ with the associated frequency range $f_{Tvmin} \leqq f_{Inv} \leqq f_{Tvmax}$ which is given by the requirements for the preheating of the filaments of the lamp.
2. The Q-factor G2 of the load circuit with a struck lamp, with the resonance $f_{res2}$.

The upper limit $f_{TVmax}$ for the inverter frequency $f_{Inv}$ during the preheating phase TV is given in that, for a given preheating duration TV, the preheating current should not fall below a minimum preheating current $I_L$ for the lamp filaments used, or else the filaments will not be sufficiently capable of emitting light.

The lower limit $f_{TVmin}$ for the inverter frequency $f_{Inv}$ during the preheating phase TV is given in that the voltage $U_L$ across the lamp EL at the capacitor C5 (FIG. 1) during the preheating phase of the filaments should not exceed a maximum value which is defined by the lamp, because otherwise striking may take place before the preheating has finished (early striking).

In the method according to the invention for operating a discharge lamp EL, the frequency $f_{Inv}=f_{TV}$ of the inverter, and therefore of the load current $I_L$, is regulated in such a way that it approximately coincides with the lower limit $f_{Tvmin}$ of the frequency range. This achieves optimum preheating of the filaments in a very short time. In addition to this significant advantage of the method according to the invention, the method affords the further advantage that the reduction in the quality of the load circuit (and therefore of the current drawn at constant frequency) following the heating of the filaments can be reacted to in such a way that, by controlled reduction in the inverter frequency $f_{Inv}$, the voltage across the lamp and the current through the filaments during the preheating remain approximately constant.

At the end of the preheating phase TV, the frequency $f_{Inv}=f_{TZ}(t)$ of the inverter is reduced in such a way that it approximately equals the resonance $f_{res1}$ of the load circuit, and a voltage $U_L$ across the lamp (EL/C5) is generated which is sufficient for striking the lamp.

As described above, at the instant when the lamp EL is struck, the resonance of the load circuit jumps to the value $f_{res2}$, since the capacitor (C5 in FIG. 1) in parallel with the lamp is then almost short-circuited by the lamp. During and after striking, the load circuit has a natural resonant frequency considerably lower than the natural resonant frequency before striking.

In the striking-detection according to the invention, this frequency jump is registered, the time which elapses until a setpoint current integral with respect to time is reached by the actual current integral with respect to time is compared with the period $t_{TG}$ of a clock generator.

The frequency $f_{TG}$ (FIG. 3) of the clock generator is, according to the invention, selected in such a way that it is less than the resonant frequency $f_{res1}$ and greater than the resonant frequency $f_{res2}$.

During the preheating, the frequency $f_{TG}$ of the clock generator TG is, according to the invention, less than the inverter frequency $f_{Inv}$ until the lamp has been struck.

After the lamp EL is struck, according to the invention, the time interval during which the actual current integral with respect to time is integrated up in the current regulator circuit SR to the value corresponding to the setpoint value is longer than the period $t_{TG}$ of the clock generator TG. This means that the frequency $t_{TG}$ of the clock generator TG is greater than the inverter frequency $f_{Inv}$ after the lamp has been struck.

In the starting phase TA and in the normal operating phase TN, the inverter frequency $f_{Inv}$ is regulated in such a way that, for a currently specified Q-factor G2 of the load circuit with the lamp struck, the desired load current $I_L$ is set. $f_{TA}$ is the inverter frequency $f_{Inv}$ in the starting phase, and $f_{TN}$ is the inverter frequency $f_{Inv}$ in the normal operating phase. During the continuous transition from the starting phase to the normal operating phase, the inverter frequency $f_{Inv}$ increases according to the reduction in the setpoint value SW4 (t) from $f_{Inv}=f_{TA}$ to $f_{Inv}=f_{TN}$.

FIG. 4 shows a) the time profile of the load current setpoint values, b) the output voltage of the timer component of the clock generator TG, c) the voltage at the output TGA1 of the clock generator TG, d) the voltage at the output TGA2 of the clock generator TG, e) the voltage at the output ASA1 of the output stage AS, e1) the voltage/the output TT1A1 of the driver TT1, e2) the voltage at the output TT2A1 of the driver TT2, f) the voltage at the output SRA1 of the current regulator circuit SR, g) the voltage at the output ZA1 of the counter Z, and h) the voltage at the output ZA2 of the counter Z.

The voltage profiles are represented for the preheating phase TV, the striking phase TZ with the striking time $t_Z$, the starting phase TA and for normal operation TN.

FIG. 4*a* represents the evolution of the setpoint values SW1, SW2(t), SW3, SW4(t) and SW5. The value SW2(t) increases until striking is detected (time $t_{ZE}$). SW3 is formed in the time period TA1. Subsequent to this (when the counter has reached a particular counting state), in time period TA2 the setpoint value SW4(t) is formed as a function of the analog signals formed by DAW. Finally, subsequent to this (when the counter has reached a further particular counting state) the setpoint value SW5 is formed in the time period TN.

FIG. 4*b* represents the profile of the output voltage of the timer component of the clock generator TG. In the time periods TV, TA (TA1 and TA2) and TN, the clock generator works in free-running operation with the period $t_{TG}$. From the beginning of the striking phase TZ, the timer component is shifted to its initial state, and thereby synchronized with the frequency $f_{Inv}$ of the inverter, the first time and each further time a signal occurs at the output SRA1 of the current controller SR. If, as a result of the striking of the lamp, no signal occurs at the output SRA1 within the period $t_{TG}$ the striking of the lamp which has taken place at time $t_Z$ is thereby registered and the striking phase is terminated.

FIG. 4*c* represents the signals at the output TGA1 of the clock generator TG. A switching pulse occurs whenever the time component of the clock generator is set to its initial state (FIG. 4*b*). During the striking phase TZ, the frequency of the switching pulses at TGA1 corresponds to the inverter frequency $f_{Inv}$ (synchronized operation), and outside the striking phase it corresponds to the frequency $f_{TG}$ of the free-running clock generator.

The signals at the output TGA2 of the clock generator TG are represented in FIG. 4*d*. A switching pulse occurs only if the timer component of the clock generator is set to its initial state by the feedback network at the end of its period $t_{TG}$ (FIG. 4*b*). During the striking phase TZ, no switching pulses occur so long as the timer component is reset by the signals at the input TGE1 before the period $t_{TG}$ has elapsed.

FIG. 4*e* shows the output signal ASA1 of the output stage AS. The two half-bridge switching elements T1, T2 are driven as a function of the value of the output signal, as shown in FIGS. 4*e*1 and 4*e*2. Directly after each change of state, during which an activated switching element is deactivated, a dead time $t_T$ begins, after the elapsing of which the previously inactive switching element is activated.

FIG. 4*f* represents the signals at the output SRA1 of the current regulator circuit SR. A switching pulse occurs whenever the registered actual current integral with respect to time is greater than the predetermined setpoint current integral with respect to time. The switching pulses cause a change of state of the output stage AS or of the signal ASA1 (FIG. 4*e*). Directly after the striking time $t_Z$, no switching pulse occurs at the output SRA1 within a period $t_{TG}$ of the clock generator TG.

FIG. 4*g* shows the output signal ZA1 of the counter Z, which indicates the striking phase TZ, for example by a signal "1".

FIG. 4*h* shows the output signal ZA2 of the counter Z, which indicates that the lamp EL is on (starting phase TA and normal operating phase TN), for example by a signal "1".

I claim:

1. Method for operating a discharge lamp (EL), with a load circuit which contains the discharge lamp (EL), a capacitor (C5) connected in parallel therewith, a coil (L2), at least one further capacitor (C6) and an element (R2) which registers a load current ($I_L$) flowing in the load circuit, and with an inverter with two switching elements (T1, T2) which are externally controlled with a frequency ($f_{Inv}$) of the inverter, characterized in that the following procedural steps are carried out in the preheating phase (TV)

registering the actual value of the load current ($I_L$);

forming a first, time-invariant setpoint value (SW1) of the load current ($I_L$), which corresponds to a desired actual value of a load current in the preheating phase;

activating a clock generator (TG) which runs freely at a frequency ($f_{TG}$) which is less than the resonant frequency ($f_{res1}$) of the load circuit when the lamp is off and is greater than the resonant frequency ($f_{res2}$) of the load circuit when the lamp is on;

terminating the preheating phase after a first predeterminable time period (TV) has elapsed;

in the striking phase (TZ)

registering the actual value of the load current ($I_L$) in the load circuit;

forming a time-varying setpoint value (SW2(t)) of the load current, which setpoint value (SW2(t)) is brought from a time-invariant setpoint value (SW1) of the load current ($I_L$) to a predeterminable value (SW2max);

synchronizing the clock generator (TG) with the frequency ($f_{Inv}$) of the inverter;

terminating the striking phase as soon as the setpoint value of the load current ($I_L$) has reached a value at which the on-time of a half-bridge switching element is greater than the period ($t_{TG}=1/f_{TG}$) of the free-running clock generator (TG), in normal operation (TN)

registering the actual value of the load current ($I_L$); and forming a second, time-invariant setpoint value (SW5) of the load current, which setpoint value (SW5) corresponds to a desired actual value of the load current in normal operation.

2. Method according to claim 1, characterized in that, in a first time period (TA1) of a starting phase (TA) directly after the termination of the striking phase, a third, time-invariant setpoint value (SW3) of the load current is formed.

3. Method according to claim 2, characterized in that, in a second time period (TA2) of the starting phase (TA), a second, time-varying setpoint value (SW4(t)) is formed, which is changed, from the third time-invariant setpoint value (SW3) continuously to the second time-invariant setpoint value (SW5).

4. Method for operating a discharge lamp (EL), with a load circuit which contains the discharge lamp (EL), a capacitor (C5) connected in parallel therewith, a coil (L2), at least one further capacitor (C6) and an element (R2) which registers a load current ($I_L$) flowing in the load circuit, and with an inverter with two switching elements (T1, T2) which are externally controlled with a frequency ($f_{Inv}$) of the inverter, characterized in that each individual half-period of the load current is regulated to a predeterminable setpoint value in each operating phase of the lamp, and in order to regulate the period of the load current, the actual value of the integral of the current with respect to time in a half-oscillation or a full-oscillation of the load current is registered, and this integral is compared with the setpoint value of the integral of the current with respect to time in a half-oscillation or a full oscillation of the load current in the respective current operating phase, in that when the actual and setpoint values of the load current coincide, the inverter is driven in such a way that the switching element (T2) activated at this particular time is deactivated and the switching element (T1) not activated at this particular time is activated.

5. Method according to claim 4, characterized in that the positive and negative half-cycles of the load current ($I_L$) are regulated to the same setpoint value.

6. Method according to claim 4, characterized in that a predeterminable dead time ($t_T$) is produced between the deactivation of the switching element (T2) activated at this particular time and the activation of the switching element (T1) not activated at this particular time.

7. Circuit arrangement for operating a discharge lamp (EL), with a load circuit which contains the discharge lamp (EL), a capacitor (C5) connected in parallel therewith, a coil (L2), at least one further capacitor (C6) and an element (R2) which registers a load current ($I_L$) flowing in the load circuit, and with an inverter with two switching elements (T1, T2) which are externally controlled with a frequency ($f_{Inv}$) of the inverter, the circuit arrangement comprising:

means for registering the actual value of the load current ($I_L$) in a preheating phase (TV);

means for forming a first, time-invariant setpoint value (SW1) of the load current ($I_L$), which corresponds to a desired actual value of a load current in the preheating phase;

means for activating a clock generator (TG) which runs freely at a frequency ($f_{TG}$) which is less than the resonant frequency ($f_{res1}$) of the load circuit when the lamp is off and is greater than the resonant frequency ($f_{res2}$) of the load circuit when the lamp is on;

means for terminating the preheating phase after a first predeterminable time period (TV) has elapsed;

means for registering the actual value of the load current ($I_L$) in the load circuit in a striking phase (TZ);

means for forming a time-varying setpoint value (SW2(t)) of the load current, which setpoint value (SW2(t)) is brought from a time-invariant setpoint value (SW1) of the load current ($I_L$) to a predeterminable value (SW2max);

means for synchronizing the clock generator (TG) with the frequency ($f_{Inv}$) of the inverter;

means for terminating the striking phase as soon as the setpoint value of the load current ($I_L$) has reached a value at which the on-time of a half-bridge switching element is greater than the period ($t_{TG}=1/f_{TG}$) of the free-running clock generator (TG);

means for registering the actual value of the load current ($I_L$) in normal operation (TN);

means for forming a second, time-invariant setpoint value (SW5) of the load current, which setpoint value (SW5) corresponds to a desired actual value of the load current in normal operation.

8. Circuit arrangement according to claim 7, characterized by a control circuit (IC) for driving the externally controlled switching elements (T1, T2), operating parameters of the control circuit (IC) being predeterminable through resistors (R3, R4, R5, R6).

9. Circuit arrangement according to claim 8, characterized in that the control circuit (IC) has the clock generator (TG), a striking-detection circuit (ZE) and a counter (Z).

10. Circuit arrangement according to one of claim 9, characterized in that the clock generator (TG) has a timer component which defines the period ($t_{TG}$) of its natural oscillation frequency ($f_{TG}$), and is configured in such a way that the counter (Z) is provided with a pulse when the timer component is reset to the state which it has at the beginning of a period.

11. Circuit arrangement according to claim 10, characterized in that the clock generator (TG) has a control input (TGE1) with which, independently of the instantaneous state of its timer component, the beginning of each period of an oscillation frequency differing from the natural oscillation frequency ($f_{TG}$) is predetermined.

12. Circuit arrangement according to claim 10, characterized in that the striking-detection circuit (ZE) enables signal channels (ASA1-TGE1; TGA2-ASE3) from an output stage (AS) to the clock generator (TG), in such a way that the timer component of the clock generator (TG) is set by control pulses of the output stage (AS) to the state corresponding to the beginning of a period of the timer component, and that a control pulse at an output (TGA2) of the clock generator (TG) is fed to the output stage (AS).

13. Circuit arrangement according to claim 10, characterized in that, at an output (TGA2) of the clock generator (TG) in the striking phase (TZ), a pulse is produced at the particular time when the duration between two consecutive switching pulses at the control input (TGE1) of the clock generator (TG) is greater than the period ($t_{TG}$) of the period of the natural oscillation frequency ($f_{TG}$) of the clock generator (TG), defined by the timer component.

14. Circuit arrangement according to claim 13, characterized in that, the first time a switching pulse occurs at the output (TGA2) of the clock generator (TG) in the striking phase (TZ), the striking-detection circuit (ZE) is deactivated and the striking phase is terminated.

15. Circuit arrangement according to claim 10, characterized in that the striking phase (TZ) is terminated at the latest when a predeterminable counter state of the counter (Z) is reached.

16. Circuit arrangement according to one of claim 9, characterized in that the clock generator (TG) is connected to the counter (Z) which counts output signals of the clock generator (TG) and which, when the predeterminable counts are reached, forms signals which are used for forming the setpoint values (SW1, SW2(t), SW3, SW4(t), SW5) of the load current.

17. Circuit arrangement according to claim 16, characterized in that the signals are specific to the operating phases.

18. Circuit arrangement according to claim 9, characterized in that the striking-detection circuit (ZE) is activated by the counter (Z) when a predeterminable counter state which indicates the beginning of the striking phase (ZT) is reached.

19. Circuit arrangement according to claim 8, characterized in that the control circuit (IC) has a current setpoint-value generator circuit (SWE).

20. Circuit arrangement according to claim 19 characterized in that the control circuit (IC) has a current regulator circuit (SR).

21. Circuit arrangement according to claim 8, characterized in that the control circuit (IC) has a lag component (TZG) and a first and a second driver (TT1, TT2) for the externally controlled switching elements (T1, T2).

22. Circuit arrangement according to claim 21, characterized in that the dead time ($t_T$) of the lag component (TZG) can be adjusted through a resistor (R5).

23. Circuit arrangement according to one of claim 8, characterized in that the control circuit (IC) is produced as an integrated circuit.

24. Circuit arrangement according to claim 7, characterized in that setpoint values for integrals of current with respect to time of the load current ($I_L$) can be adjusted separately, in each case through a resistor (R3; R4), for the operating phases in which the lamp is on and the operating phases before the striking of the lamp.

25. Circuit arrangement according to claims 7, characterized in that the frequency ($f_{TG}$) at which the clock generator (TG) oscillates can be adjusted through a resistor (R6).

* * * * *